US007594340B2

(12) United States Patent
Xedis, IV

(10) Patent No.: US 7,594,340 B2
(45) Date of Patent: Sep. 29, 2009

(54) TEMPLATE APPARATUS

(76) Inventor: Gregory A. Xedis, IV, 3550 Amber Rd., Syracuse, NY (US) 13215

( * ) Notice: Subject to any disclaimer, the term of this patent is extended or adjusted under 35 U.S.C. 154(b) by 13 days.

(21) Appl. No.: 12/153,730

(22) Filed: May 23, 2008

(65) Prior Publication Data

US 2008/0313916 A1 Dec. 25, 2008

Related U.S. Application Data

(60) Provisional application No. 60/939,787, filed on May 23, 2007.

(51) Int. Cl.
*G01D 21/00* (2006.01)
*G01B 3/14* (2006.01)
*E04H 12/20* (2006.01)

(52) U.S. Cl. ..... 33/613; 33/562

(58) Field of Classification Search ..... 33/613, 33/645, 404, 407, 562, 568, 573, 577, 526, 33/535, 666–670; 52/64–65, 71, 650–652
See application file for complete search history.

(56) References Cited

U.S. PATENT DOCUMENTS 4,004,346 A * 1/1977 Kaufman ..... 33/17 A
5,161,345 A * 11/1992 Sobjack, Sr. ..... 33/613
6,969,054 B2 * 11/2005 Sueme et al. ..... 269/37
7,152,614 B2 * 12/2006 Kalnay ..... 52/645
2003/0085501 A1 * 5/2003 Sueme et al. ..... 269/37
2008/0104907 A1 * 5/2008 Glick et al. ..... 52/239
2008/0184578 A1 * 8/2008 O'Brien ..... 33/535

* cited by examiner

*Primary Examiner*—Yaritza Guadalupe-McCall

(57) ABSTRACT

A template apparatus is provided for the construction of a wall frame. A base section includes a plurality of base units. Each base unit has two ends and has two legs generally situated at an angle to one another to form an apex; A cross member is connected to both legs opposite from the apex. A pair of journal plates, are secured to the apex at each end and extending away from the cross members. A journal is located in each journal plate above the apex. A support shaft is mounted to rotate in the journals. A template section is mounted on the support shaft. The template section includes a plurality of longitudinal members. Each longitudinal member is secured to the support shaft. A pair of alignment members are affixed to the longitudinal members. The alignment members are located on opposite sides of the support shaft. Alignment pins are located on the alignment members. Each alignment pin is mounted in a container with a spring beneath each alignment pin to force the alignment pin out of its respective container while permitting each alignment pin to be forced back into its respective container. Each alignment pin is generally vertically oriented when the longitudinal members are generally horizontal. Clamps are mounted on each longitudinal member.

8 Claims, 4 Drawing Sheets

TEMPLATE APPARATUS

RELATED APPLICATIONS

This Application claims priority based upon Provisional Application Ser. No. 60/939,787 filed on May 23, 2007.

BACKGROUND OF THE INVENTION

1. Field of the Invention

This invention relates to the construction of wall frames, and more particularly, to a template for constructing wall frames.

2. Prior Art

The use of frame walls, often referred to as "stud walls," is universally known. Standard building materials, such as two by fours and two by sixes, are placed vertically on a bottom plate at the bottom of the wall frame and with a top plate at the top of the wall frame. Studs are placed vertically between the base plate and the top plate and are spaced from one another at a predetermined distance, often times on sixteen inch centers. However, the spacing of the studs may be more or less than sixteen inches on centers. Usually, the building materials for wall frames are purchased with the desired length but, if not, the building materials must be cut to the desired length.

Wall frames are frequently partially constructed in a horizontal position and then are lifted to a vertical position. In the past. the spacing of the building materials has been done individually by measurement.

OBJECTS

The objects of this invention are to provide a template apparatus for the construction of a wall frame that provides and permits as follows:

1. Accurate placement of building materials and retention of such building materials without measurement.
2. Retention of the building materials in place for ready assembly of the wall frames.
3. Construction of a wall frame quickly and accurately.
4. Construction of a wall frame by only one person.

These and other objects of the present invention will become apparent from further review of the following specification and drawings.

SUMMARY OF THE INVENTION

A template apparatus for the construction of a wall frame includes a base section and a template section. The base section includes a plurality of base units and includes a plurality of base units each base unit having an upper end forming an apex. Journal plates each with a journal are located at the apex at each one of the two ends of the template apparatus. A support shaft is mounted to rotate in the journals. The template section also include longitudinal members secured to the support shaft. The template section further includes alignment pins and clamps for holding a wall frame in position on the template section for the wall frame to be secured together.

BRIEF DESCRIPTION OF THE NUMERALS

| NUMERAL | DESCRIPTION |
|---|---|
| 11 | Template Section |
| 15 | Base Units |
| 17 | Wall Frames |
| 19 | Legs |

-continued

| NUMERAL | DESCRIPTION |
|---|---|
| 21 | Apex |
| 23 | Cross Members |
| 25 | Foot |
| 26 | Foot Member |
| 27 | Wheel |
| 28 | Foot Plate |
| 29 | Journal Plate |
| 31 | Journal |
| 33 | Support Shaft |
| 35 | Lock Pin |
| 37 | Building Materials |
| 39 | Longitudinal Members |
| 41 | Alignment Members |
| 43 | Alignment Pins |
| 45 | Container |
| 47 | Spring |
| 49 | Upper End |
| 51 | Stop |
| 53 | Top End |
| 55 | Lower End |
| 57 | Bottom Plate |
| 59 | Top Plate |
| 61 | Clamps |
| 63 | Studes |

DETAILED DESCRIPTION OF THE PREFERRED EMBODIMENT

Figure 1:
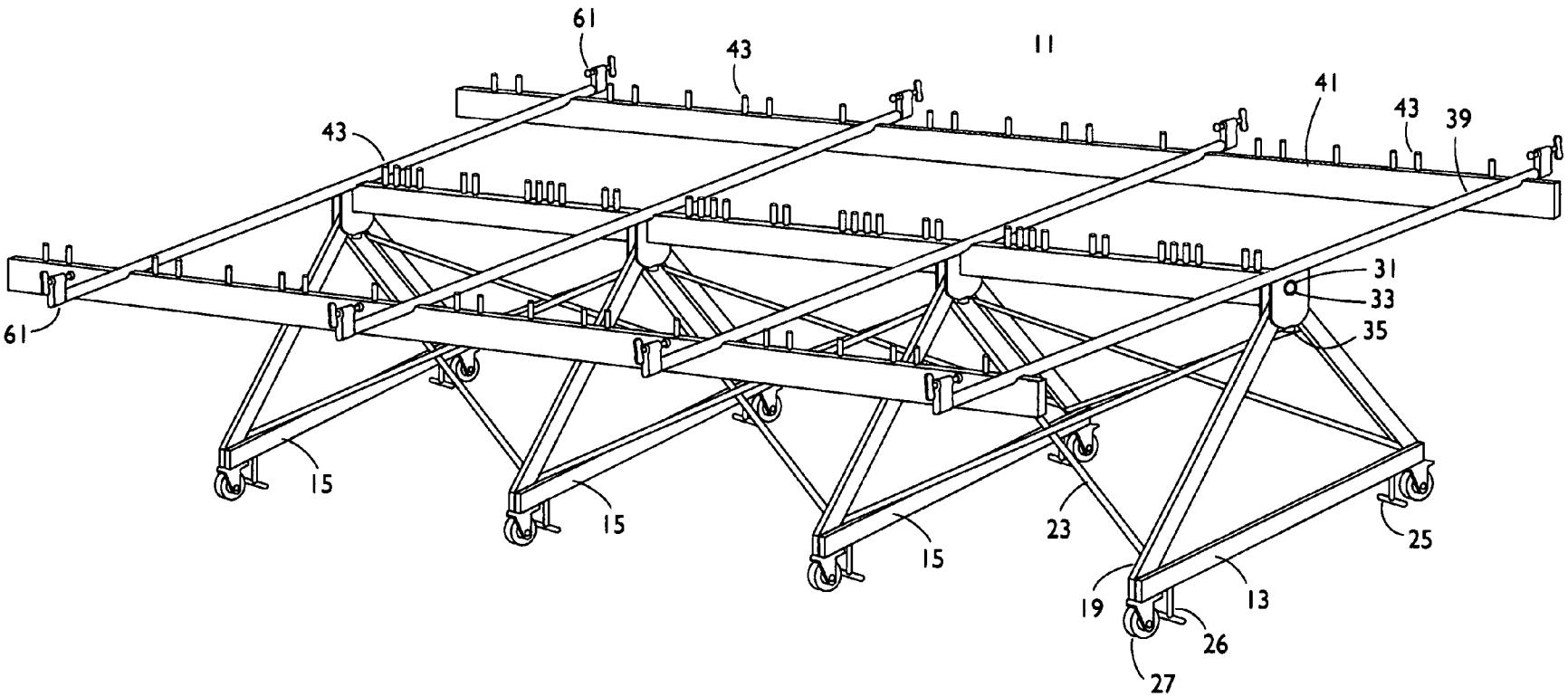
FIG. 1 is a pictorial view of the template apparatus with the template section generally situated in a horizontal position.
Figure 2:
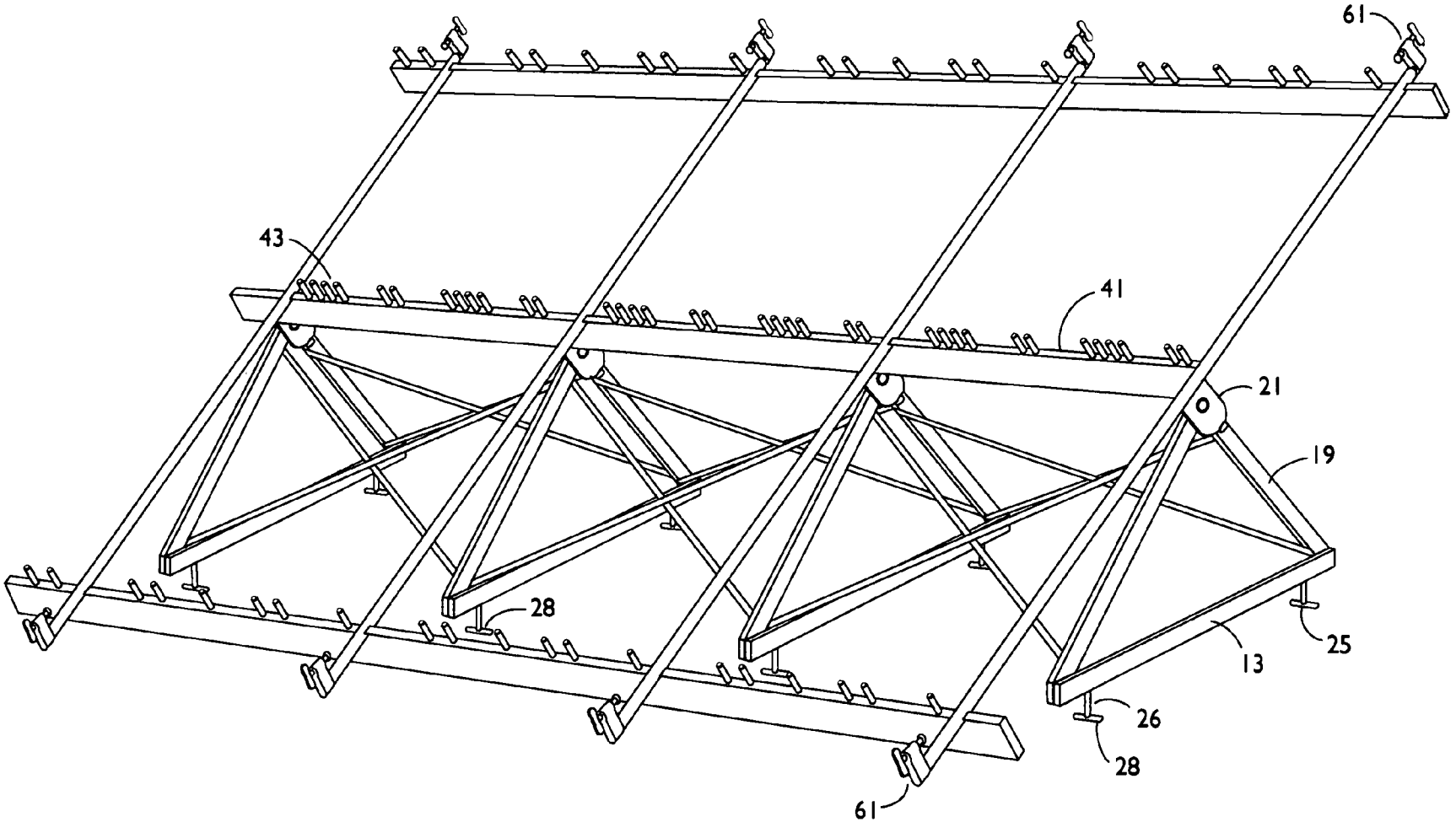
FIG. 2 is a pictorial view of the template apparatus shown in FIG. 1 but with the template section tilted.
Figure 3:
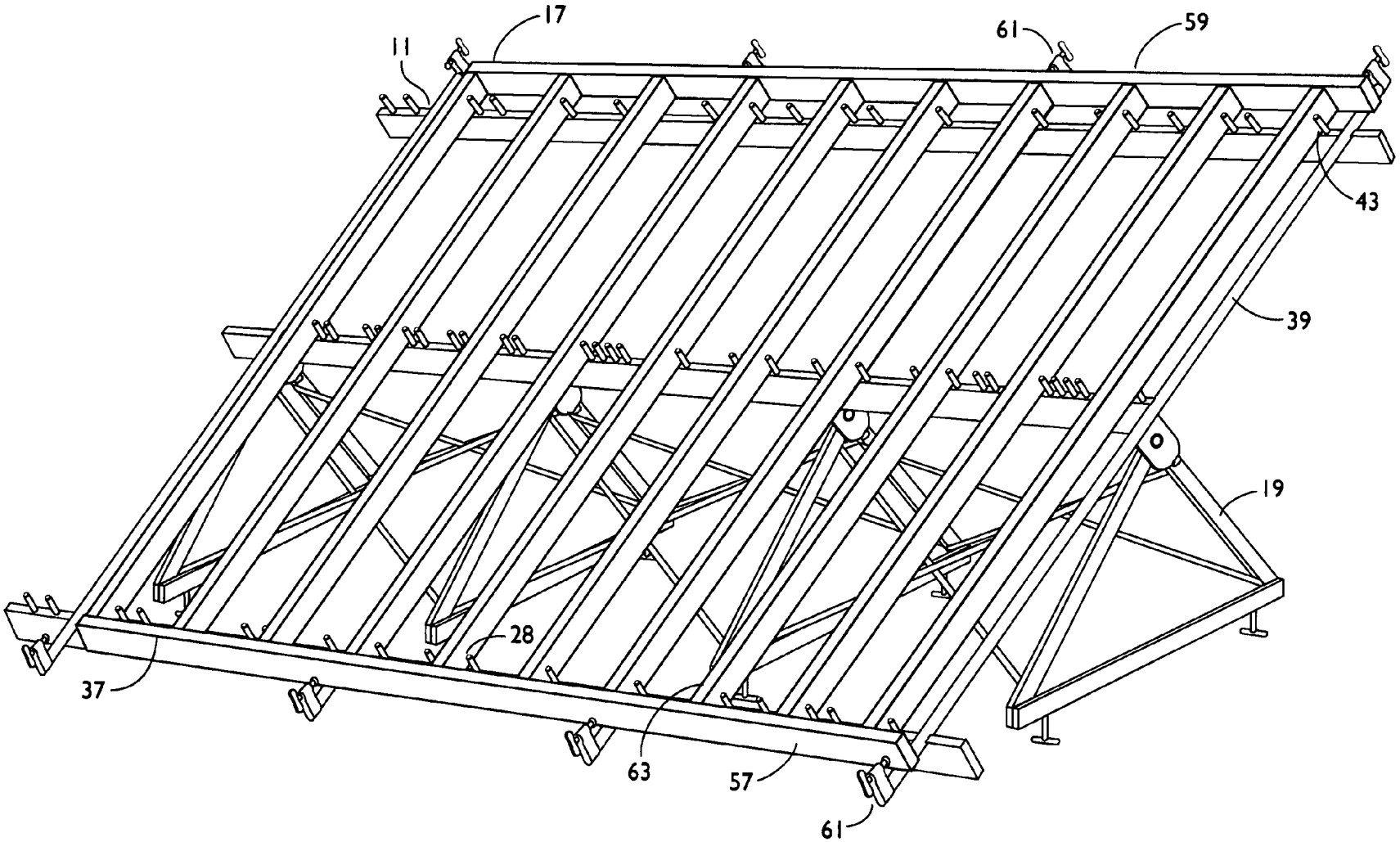
FIG. 3 is a is a pictorial view similar to FIG. 1 and FIG. 2 but with a wall under construction on the template section.

The template apparatus, which might also be termed a form or a jig, has two major sections, namely, a template section 11 and a base section 13. The base section 13 includes multiple and generally identical base units 15 substantially equally spaced from one another. In FIG. 1 four base units 15 are shown. The number of base units 15 can be increased and decreased depending upon the size of the template apparatus and the size of the wall frame 17 (FIG. 3) to be constructed in the template section 11.

Each base unit 15 includes two legs 19 generally situated at an apex 21 with an angle between the two legs 19. A cross member 23 is located in each base unit opposite from the apex 21. The cross member 23 is generally parallel to the ground on which the template apparatus is located. At the foot 25 of each leg 19, a foot member 26 is located. The foot member 26 may be a wheel 27 or may be a foot plate 28. If the foot member 26 is a wheel 27, the wheel 27 requires a lock to prevent the template apparatus from rolling when in use. Wheels which can be locked are commercially available. Wheels 27 which can be locked so as to prevent rotation of the wheels 27 are clearly superior to foot plates 28. However, the wheels may be replaced by foot plates 28. The wheels 27 which can be locked to prevent rolling, are obviously superior to foot plates 28.

At both ends of each base section 13 t the apex 21, at the top of each base section 13, a journal plate 29 is located. All of the journal plates 29 are secured in a vertical position. All journal plates 29 are secured to both legs 19 of the base section 13. Both journal plates 29 extend above the apex 21 and away from the ground and a cross member 23. A journal 31 is located in each journal plate 29 directly above the top of the apex 21 and generally above the center of the journal plate 29.

The template section 11 is mounted on a support shaft 33 which is mounted in the journals 31 in the journal plates 29. The template section 11 is supported and rotates on the base section 13 by means of the support shaft 33. The support shaft 33 may be locked in any desired position by means of a lock pin 35. As a result, the template section 11 may be locked in any one of an infinite number of positions which may be horizontal or tilted in either direction to a wide variety of degrees to permit the most desirable access to building materials 37 retained in the template section 11 for the construction of a wall frame The template section 11 has a plurality, preferably four, as shown in FIG. 1, of longitudinal members 39 which are secured, generally at the center point of each longitudinal member 39, to the support shaft 33. The longitudinal members 39 are generally equally spaced from one another and are parallel and aligned with one another.

The template section 11 has three alignment members 41 of which two are located on opposite sides of the support shaft 33 and are both generally parallel to the support shaft 33 and are also generally equally spaced from the support shaft 33 but on opposite sides of the support shaft 33. The third alignment member 41 is located substantially directly above the support shaft 33.

The alignment members 41 and the support shaft 33 have alignment pins 43 mounted on them. When the template section 11 is generally in a horizontal position, the alignment pins 43 are generally vertically oriented.

The alignment pins 43 on both the support shaft 33 and the alignment members 41 can be either depressed or rotated over so as no longer to be functional as to the template section 11. The alignment pins 43, which can be depressed, (FIG. 4) are the most desirable.

Each alignment pin 43 is placed in a container 45. A spring 47, beneath the alignment pin 43, forces the alignment pin 43 out of the upper end of the container 45 but only up to a stop 51 on the alignment pin 43 but only up to the top of a slot 48 in the container 45. The stop 51 located horizontally across each alignment pin 43 and in the slot 48 prevents further movement of each alignment pin 43 further out of its respective container 45. Pressure applied to any alignment pin 43 forces such alignment pin 43 back into its respective container 45. Any alignment pin 43 forced back into its respective container 45 is eliminated from usage when in such container 45. Some alignment pins 43 may be fixed and not be spring loaded. This is possible when there is a set pattern for the wall frame 17.

Figure 4:
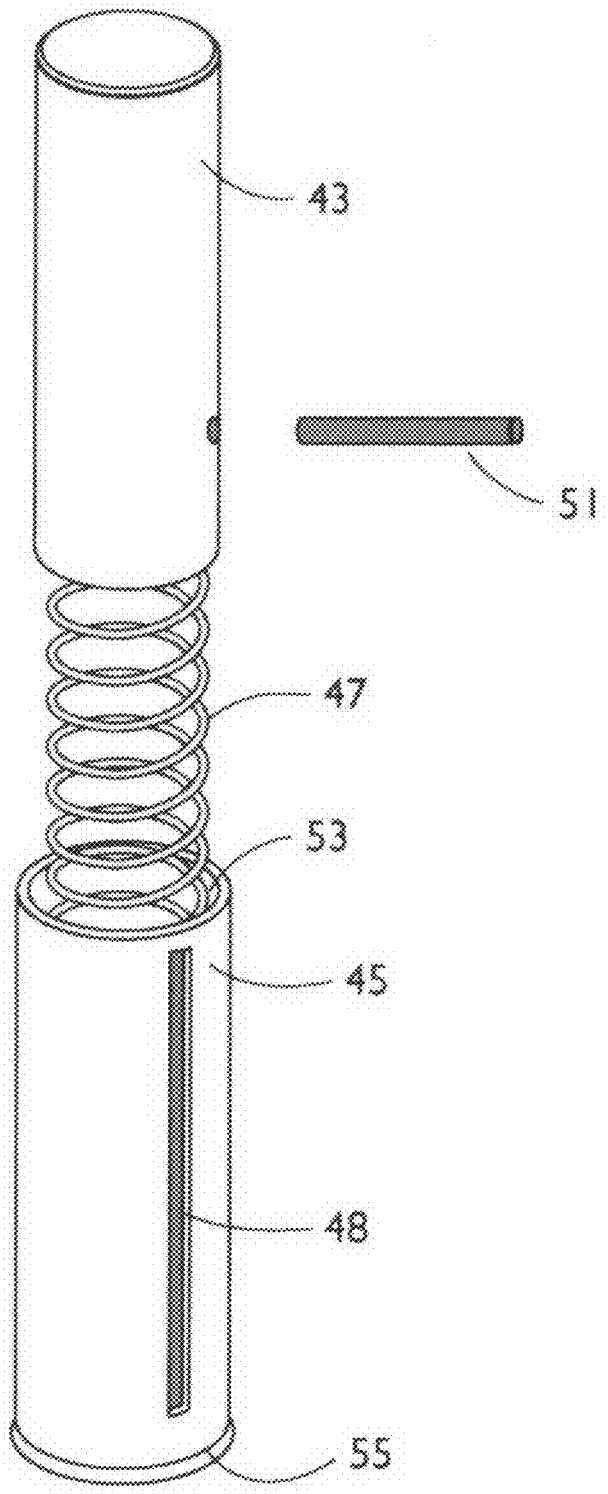
FIG. 4 is a side elevation of an alignment pin with the internal operation of the alignment pin exposed.

In FIG. 4, an alignment pin 43 is shown in a container 45 while also having the operation of the alignment pin 43 within its respective container 45. The alignment pin 43 is a hollow cylindrical member which slides from the container 45 which is also hollow and cylindrical. The top end 53 of the container 45 is open to permit its respective alignment pin to move in and out of the container 45. The lower end 55 of the container 45 is closed. The spring 47 is located between the lower end 55 of the container and extends into the alignment pin 43.

Building materials 37, such as two by fours and two by sixes, are placed between the alignment pins 43. The alignment pins 43 which are selected depends upon the desired spacing of the building materials 37. Measuring is not necessary as the alignment pins 43 control the spacing.

With the building materials 37 in place, the bottom plate 57 and the top plate 59 are placed on the longitudinal members 39. Clamps 61 are located in the outer ends of both longitudinalt members 39 and force the bottom plate 57 and the top plate 59 against the studs 63. Alignment pins 41 are spaced for studs 63. Alignment pins 41 are spaced for studs 63 and are recessed for doors, windows as well as other openings.

Once the wall frame 17 is secured within the template section 11, the building materials 37 can be secured into a wall frame 17. Rotation of the template section 11 in permits conveniently securing the wall frame 17 together with a proper and square alignment.

While a preferred embodiment is shown, it should be understood that the present disclosure is made by way of example only and that variations in the described template are possible within the scope of the following claims, and a reasonable equivalency thereof, which claims I regard as my invention.

The invention claimed is:

1. A template apparatus for the construction of a wall frame comprising:

a base section including a plurality of base units and having two ends, each base unit having an upper end forming an apex;

a journal plate secured at the apex at each end of the template apparatus, the journal plate extending vertically above the apex, each journal plate having a journal mounted therein directly above the apex;

a template section including a support shaft, the support shaft being mounted to rotate in the journals, the template section including a plurality of longitudinal members secured to the support shaft, the template section further including alignment pins, the wall frame being located by the alignment pins;

means to secure the template section in a fixed position; and clamping means to hold the frame wall in the fixed position.

2. A template apparatus according to claim 1 wherein the alignment members are located on opposite sides of the support shaft.

3. A template apparatus according to claim 1 wherein each alignment pin is mounted in a container with a spring beneath the alignment pin.

4. A template apparatus according to claim 1 wherein the alignment pins are generally vertically mounted when the longitudinal members are generally horizontal.

5. A template apparatus for the construction of a frame wall comprising:

a base section including a plurality of base units, each base unit having two ends and having two legs generally situated at an angle to one another to form an apex;

a cross member connected to both legs opposite from the apex;

a pair of journal plates, one journal plate being secured to the apex at each end and extending away from the cross members;

a pair of journals, each journal being located in each journal plate above the apex;

a support shaft mounted to rotate in the journals;

a plurality of longitudinal members being secured to the support shaft;

three alignment members affixed to the longitudinal members, two of the alignment members being located on opposite sides of the support shaft, the third alignment member being located adjacent the support shaft;

alignment pins on the alignment members, each alignment pin being mounted in a container with a spring beneath each alignment pin to force each alignment pin out of their respective container while permitting each alignment pin to be forced back into its respective container, each alignment pin being generally vertically oriented when the longitudinal members are generally horizontal; and clamps mounted on each longitudinal member.

6. A template apparatus according to claim 5 wherein two of the alignment members are located generally equidistant on opposite sides of the support shaft.

7. A template apparatus according to claim 5 wherein the center point of each longitudinal member is located at the support shaft.

8. A template for the construction of a frame wall comprising:

a base section including multiple base units generally equally space from one another, each base unit including two legs generally situated at a right angle to one another to form an apex, a cross member connected to both legs opposite from the apex;

a plurality of journal plates, each journal plate being secured to the apex and extending away from the cross members;

a plurality of journals, one journal being located in each journal plate above the apex;

a support shaft mounted to rotate in the journals;

a template section mounted on the support shaft, the template section including a plurality of longitudinal members, each longitudinal member being secured substantially at the center point of the longitudinal member to the support shaft;

three alignment members affixed to the longitudinal members, two longitudinal members being on opposite sides and generally equally spaced from the support shaft;

alignment pins on the alignment members, each alignment pin being mounted in a container with a spring beneath each alignment pin to force the alignment pins out of its respective container while permitting each alignment pin to be forced back into its respective container, each alignment pin being generally vertically oriented when the longitudinal members are generally horizontal; and clamping means mounted on each longitudinal member and means to move the clamping means away from and toward the support shaft.

* * * * *